United States Patent [19]

Jasinski

[11] Patent Number: 4,533,985

[45] Date of Patent: Aug. 6, 1985

[54] ILLUMINATING DEVICE WITH MERCURY SWITCH AND ADJUSTABLE ABUTMENT TAB

[76] Inventor: Joseph J. Jasinski, Box 439, R. R. 11, Cumming, Ga. 30130

[21] Appl. No.: 634,611

[22] Filed: Jul. 26, 1984

[51] Int. Cl.[3] ..... F21V 19/02

[52] U.S. Cl. ..... 362/276; 362/100; 362/428; 362/287; 362/430; 362/372; 362/802

[58] Field of Search ..... 362/100, 276, 802, 287, 362/372, 428, 430

[56] References Cited

U.S. PATENT DOCUMENTS 2,011,692 8/1935 Simpson ..... 362/100 X
2,304,690 12/1942 Herder ..... 362/100 X
3,711,694 1/1973 Gronauer ..... 362/802 X
3,895,197 7/1975 Mizrahi ..... 362/80 X

FOREIGN PATENT DOCUMENTS 243264 2/1912 Fed. Rep. of Germany ..... 362/100

*Primary Examiner*—Peter A. Nelson
*Attorney, Agent, or Firm*—Rodgers & Rodgers

[57] ABSTRACT

A device for illuminating a keyhole comprising a housing having a top panel, an energy source and a light disposed in the housing, a conductor for providing a circuit between the energy source and the light, a switch interconnected with the conductor, and an illumination platform pivotally connected to the top panel of the housing and being adapted to swing outwardly of the housing.

4 Claims, 4 Drawing Figures

ILLUMINATING DEVICE WITH MERCURY SWITCH AND ADJUSTABLE ABUTMENT TAB

TECHNICAL FIELD

This invention relates to means for conveniently and reliably illuminating a keyhole.

BACKGROUND ART

Various device and methods are known for illuminating keyholes such as are disclosed in U.S. Pat. No. 2,011,692; 2,304,690; 2,842,657; 2,927,197; 3,590,234; and 4,787,677. These known means for illuminating keyholes are generally complicated, expensive and often inconvenient to use.

DISCLOSURE OF THE INVENTION

By this invention, an illuminating device is provided and comprises a housing having a back panel, side walls and a front panel, an energy source and a light disposed in the housing, conductor means to provide a circuit between the energy source and the light, a switch operably interconnected with the conductor, and an illumination platform pivotally connected to the front panel.

BEST MODE FOR CARRYING OUT THE INVENTION

Figure 1:
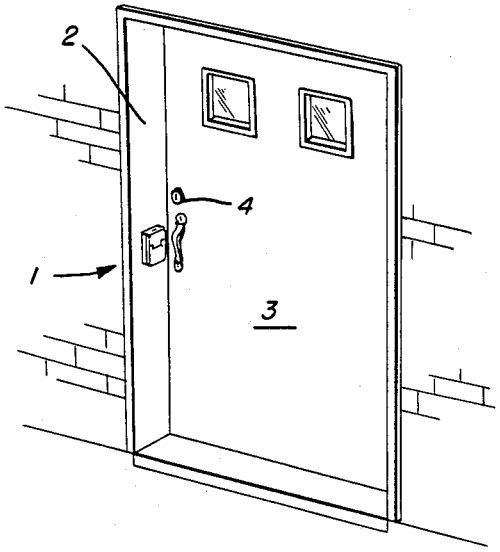
FIG. 1 is a perspective view of the illuminating device according to this invention installed in connection with a conventional door.

In the drawings, the numeral 1 generally designates the illuminating device according to this invention which is mounted on a conventional door frame 2. Door 3 is mounted in frame 2 as is well known. Also, as is well known, lock 4 is mounted in door 3.

Figure 2:
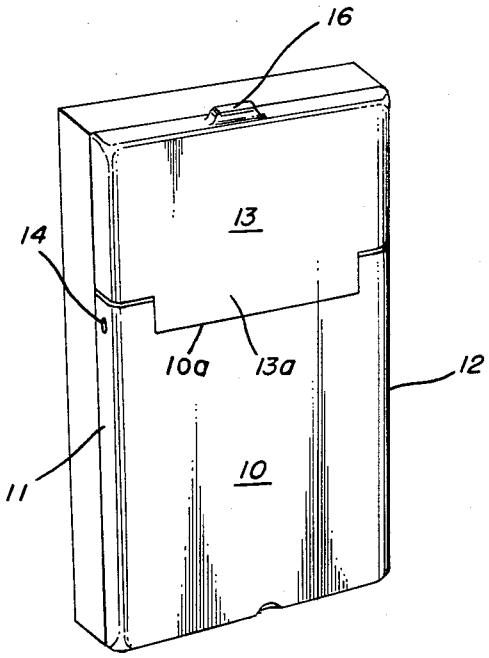
FIG. 2 is an enlarged perspective view of the illuminating device as shown in FIG. 1.

According to this invention, illuminating device 1 is provided with a housing which comprises back panel 5 and side walls 6, 7, 8 and 9 joined to the side edges of back panel 5 and upstanding therefrom. In addition, front panel 10 is joined to side walls 6, 7, and 8 along the edges thereof remote from back panel 6. Also front panel 10 is provided with shoulders 11 and 12 as best shown in FIG. 2.

According to a feature of this invention, illumination platform 13 is pivotally connected to front panel 10 by means of pins 14 and 15 which serve to interconnect respectively shoulder portions 11 and 12 of front panel 10 with illumination platform 13. In addition illumination platform 13 is provided with abutment tab 13*a* and thumb tab 16. Abutment tab 13*a* is essentially struck from front panel 10 and the lower edge of abutment tab 13*a* corresponds to abutment edge 10*a* of front panel 10.

Figure 4:
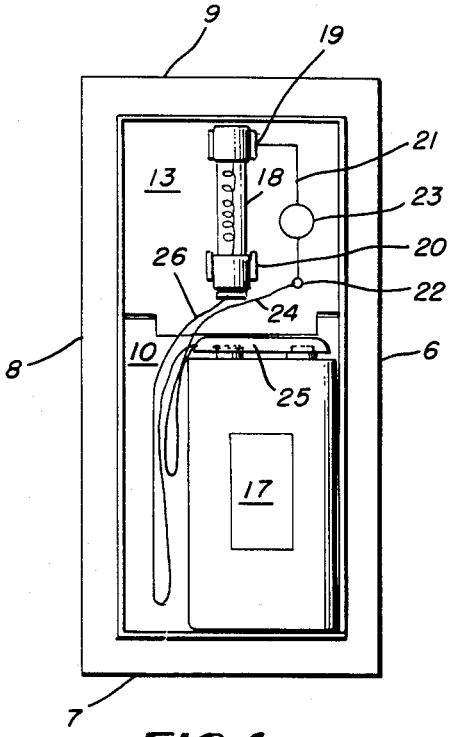
FIG. 4 is a rear elevational view with the back panel of the housing removed.

The energy source for the illuminating device is provided in the form of conventional 9-volt battery 17. A light in the form of light bulb 18 is mounted in clips 19 and 20 as is well known. Specifically clips 19 and 20 are affixed to illumination platform 13 as best shown in FIG. 4. Conductor means is provided and comprises conductor 21 which is connected to clip 19 at one end and to terminal 22 at the opposite end. Mercury switch 23 is electrically engageable with conductor 22. Conductor 24 is connected to one terminal of battery 17 by means of battery snap assembly 25 as is well known. The other end of conductor 24 is connected to terminal 22. Finally conductor 26 is connected to the other terminal of battery 17 at one end thereof and to clip 20 at the other end thereof.

Figure 3:
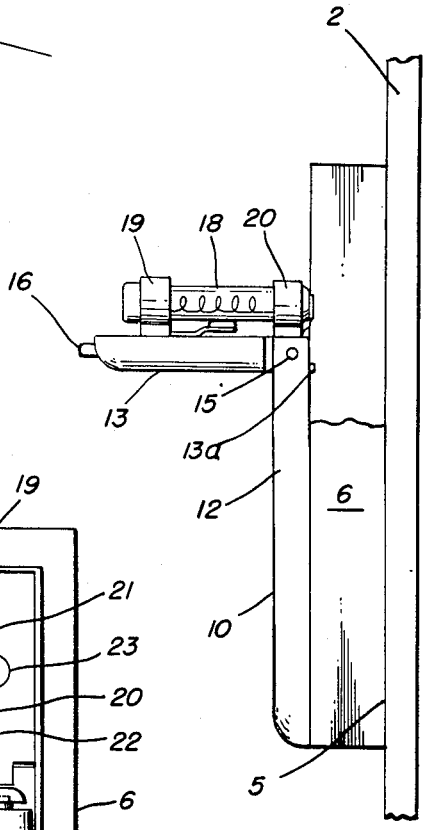
FIG. 3 is a side elevational view showing the device in the operational position with a portion of the housing side wall removed.

In actual operation the illuminating device is attached to door frame 2 as shown in FIG. 1 by any suitable means such as regular wood screws or an appropriate adhesive. Therefore when it is desired to illuminate keyhole 4, illumination platform 13 is simply swung outwardly of the housing through an arc of 90° by manual manipulation of thumb tab 16 to the position shown in FIG. 3. As this occurs mercury switch 22 functions in a conventional fashion to complete the electrical circuit and cause the energization of light 18 by means of battery 17. When not in use, illumination platform 13 is simply swung back to vertical position as shown in FIG. 2. Of course mercury switch 23 then operates to interrupt the electrical circuit with the accompanying de-energization of light 18.

In addition as illumination platform 13 is swung outwardly of the housing into a horizontal position, the outer surface thereof is caused to come into abutting relationship with abutment edge 10*a*. By this means, a proper illumination angle of illumination platform 13 is achieved whereby the light 18 is concentrated on keyhole 4 for optimum visibility.

INDUSTRIAL APPLICABILITY

By this invention, means is provided to illuminate a keyhole which is economical and reliable and at the same time allows an optimum concentration of light on the keyhole.

I claim:

1. An illuminating device comprising a housing, said housing comprising a back panel, side walls joined respectively to the side edges of said back panel and upstanding therefrom, and a front panel joined to the edges of at least some of said side walls remote from said back panel, an energy source disposed in said bearing, a light disposed in said housing, conductor means adapted to provide a circuit between said energy source and said light, a mercury switch operably interconnected with said conductor means, said front panel comprising a pair of shoulders, said illumination platform comprising an abutment tab disposed along the lower portion thereof, said illumination platform being pivotally connected to said front panel between said shoulders and the adjacent portions of said abutment tab, said illumination platform being adapted to swing outwardly of said housing through an arc of approximately 90°, said abutment tab of said illumination platform being disposed in a complementary relationship with corresponding portions of said front panel when said illumination platform and said front panel are in alignment, said front panel comprising an abutment edge disposed along the upper edge thereof between said shoulders, and a portion of the outer surface of said illumination platform being disposed in abutment with a portion of said abutment edge when said illumination platform is swung fully outwardly.

2. An illuminating device according to claim 1 wherein said light is affixed to the inner surface of said illumination platform.

3. An illuminating device according to claim 1 wherein said mercury switch is operable to cause said energy source to energize said light when said illumination platform is swung outwardly of said housing.

4. An illuminating device according to claim 1 wherein a thumb tab is disposed along the upper portion of said illumination platform.

* * * * *